United States Patent [19]

Feikema

[11] Patent Number: 4,951,594

[45] Date of Patent: Aug. 28, 1990

[54] RADAR ARCH

[76] Inventor: Orville A. Feikema, 6805 Riverview Blvd. W., Bradenton, Fla. 34209

[21] Appl. No.: 396,870

[22] Filed: Aug. 22, 1989

[51] Int. Cl.[5] ..... B63B 17/02

[52] U.S. Cl. ..... 114/361; 135/102

[58] Field of Search ..... 114/361, 354, 343; 135/102, 103; D12/317, 318

[56] References Cited

U.S. PATENT DOCUMENTS

| | | | |
|---|---|---|---|
| 3,195,549 | 7/1965 | Stevens | 114/361 |
| 3,285,259 | 11/1966 | Hale | 114/361 |
| 3,371,672 | 3/1968 | Hale et al. | 114/361 |
| 4,694,773 | 9/1987 | Sparkes et al. | 114/354 |

*Primary Examiner*—David H. Brown

*Attorney, Agent, or Firm*—Charles J. Prescott

[57] ABSTRACT

A radar arch for connection onto a deck or superstructure of a boat adapted to supportively receive and conceal a conventional convertible boat top or bimini top when not in use. The radar arch includes an arch member having a generally inverted U-shaped configuration having a recess or pocket formed into and along substantially all the leading edge of the arch member. The entire convertible top, pivotally connected at the bottom ends of the recess, is foldably receivable into the recess when not in use. An openable cover is also provided which, in cooperation with the recess, completely encloses the folded top therewithin. The cover also has an exterior configuration which is continuous with, and completes the otherwise smooth, uninterrupted leading edge area of the arch member. The cover is also closable when the convertible top is opened and in use to provide the same smooth, uninterrupted appearance to the radar arch. The arch member may also include an elongated channel for supportively retaining the transverse trailing edge of the convertible top. Various embodiments and additional features are also disclosed.

10 Claims, 3 Drawing Sheets

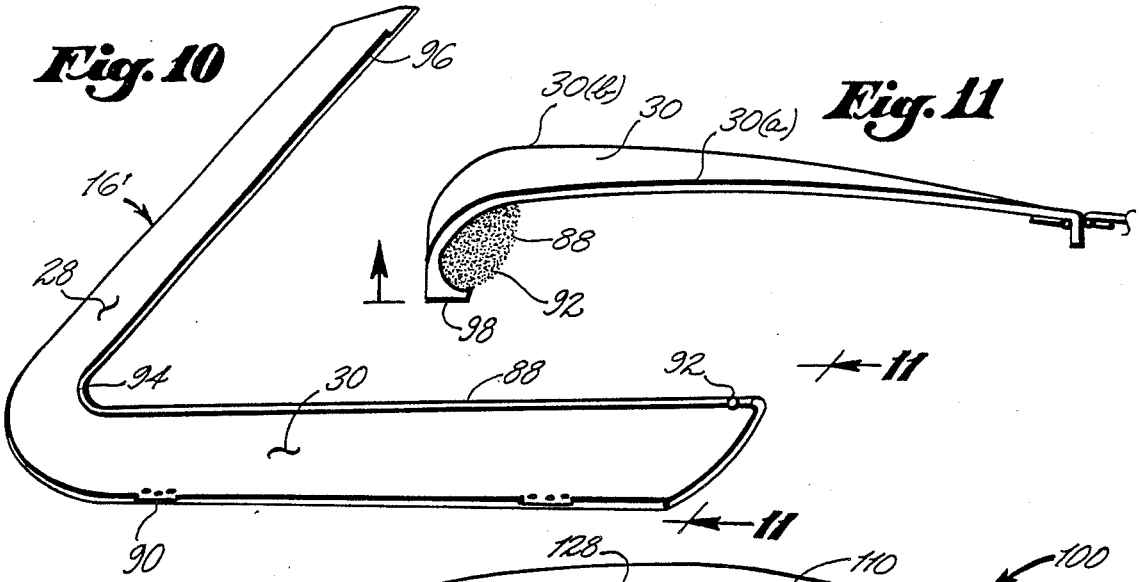
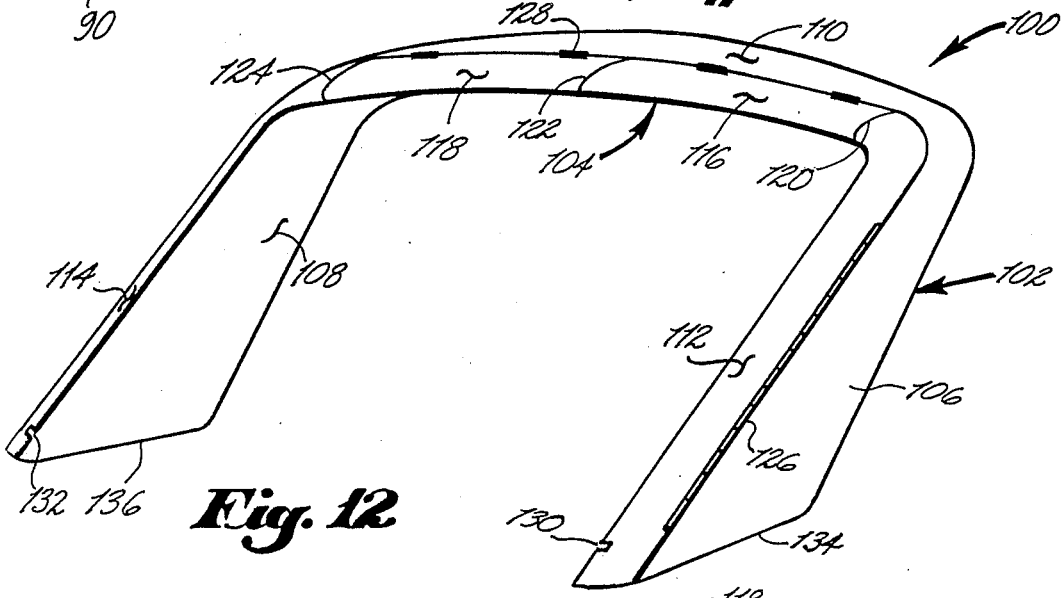
Fig. 12
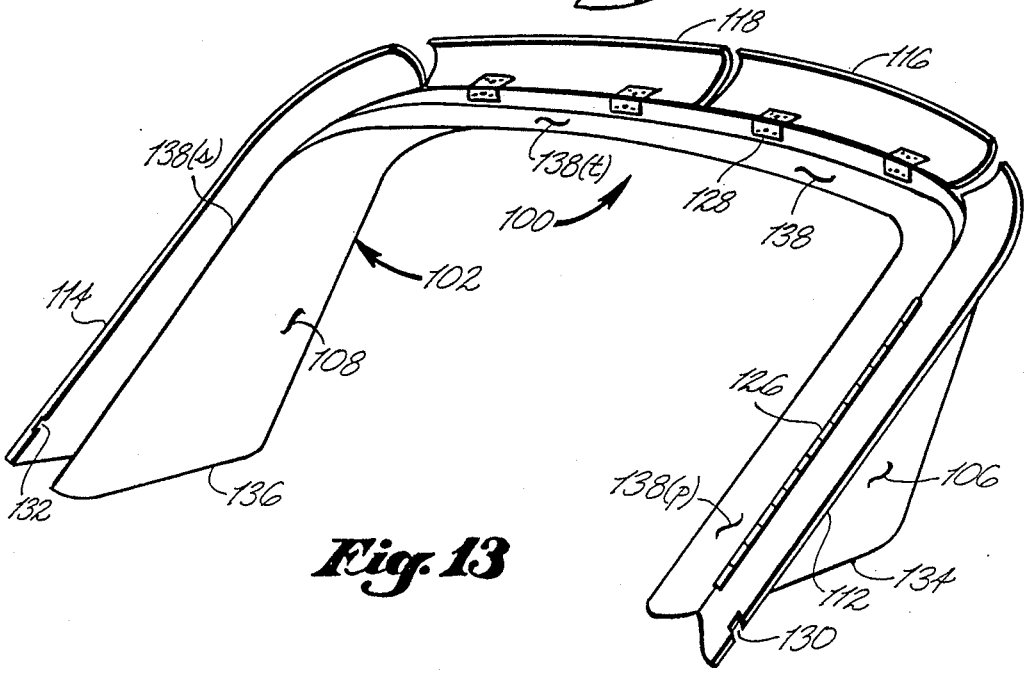
Fig. 13

RADAR ARCH

BACKGROUND OF THE INVENTION

The present invention relates generally to radar arches for boats and more particularly to a radar arch which supports and encloses convertible canvas-type tops in their stored configuration.

Presently, many boats include convertible tops and bimini tops which are fabricated of inverted U-shaped bows fabricated of relatively rigid tubing and having a flexible contoured sheet connected to span the bows in their open configuration to provide shade and protection for the occupants of the boat. Normally these convertible "tops" as they will be referred to generically hereinafter are either free-standing or are connected at their leading or forwardly edge to the upper margin of the boat's windshield. In their folded or collapsed configuration, typically these convertible tops are laid atop the upper margin of the windshield or are simply folded back against the main bow of the top which is held in a rigid diagonal position so that the folded configuration has an appearance of a small arch and typically covered with a sock or wrap for neatness.

Separately, radar arches have become quite popular and are attached to, and upwardly extending from, the deck or superstructure (such as a flybridge) of boats. These radar arches are useful for attaching antennas and radar systems thereto. Deck lights and stereo speakers are also typically found connected to these radar arches. However, despite their relatively high expense, very little additional utility has been made of these otherwise rather impressive structures. In fact, on many boats which include both convertible tops and radar arches, the two are completely free standing one to another thus having the appearance of a discontinuity of design even with respect to the most stylish of boats.

Although applicant is unaware of any prior art device or invention which is remotely close to that of the present invention, nonetheless applicant is aware of the following U.S. Patent Numbers. as prior art:

Shields U.S. Pat. Des. No. 284,754

Miller U.S. Pat. No. 3,823,431

Sparkes U.S. Pat. No. 4,694,773 et al.

The present invention provides a unique radar arch which includes all of the above attributes of a typical radar arch as previously described and also includes structural recess means adapted to house and enclose the convertible top in its folded position so that it is completely concealed when stored and also serves to support the main bow or either leading or trailing edge of the convertible top when open and in use.

BRIEF SUMMARY OF THE INVENTION

This invention is directed to a radar arch for connection onto a deck or superstructure of a boat adapted to supportively receive and conceal a conventional convertible boat top or bimini top when not in use. The radar arch includes an arch member having a generally inverted U-shaped configuration having a recess or pocket formed into and along substantially all the leading edge of the arch member. The entire convertible top, pivotally connected at the bottom ends of the recess, is foldably receivable into the recess when not in use. An openable cover is also provided which, in cooperation with the recess, completely encloses the folded top therewithin. The cover also has an exterior configuration which is continuous with, and completes the otherwise smooth, uninterrupted leading edge of the arch member. The cover is also closable when the convertible top is opened and in use to provide the same smooth, uninterrupted appearance to the radar arch. The arch member may also include an elongated channel for supportively retaining the transverse trailing edge of the convertible top. Various embodiments and additional features are also disclosed. It is therefore an object of this invention to provide a radar arch which functions as a typical radar arch and also includes support means for a convertible top.

It is another object of this invention to provide a radar arch which functions as a typical radar arch and also fully conceals the convertible top in it closed configuration.

It is yet another object of this invention to be adapted to either forwardly extending or rearwardly extending convertible tops.

In accordance with these and other objects which will become apparent hereinafter, the instant invention will now be described with reference to the accompanying drawings.

BRIEF DESCRIPTION OF THE DRAWINGS

FIG. 10 is a perspective view of the cover of FIG. 1 in its open configuration also having reinforcing fibers and a structural twist for improved closure.

FIG. 11 is a view in the direction of arrows 11—11 in FIG. 10.

FIG. 12 is a perspective view of another embodiment of the invention.

FIG. 13 is a perspective view of FIG. 12 showing the four piece cover arrangement in its open position.

DETAILED DESCRIPTION OF THE INVENTION

Figure 1:
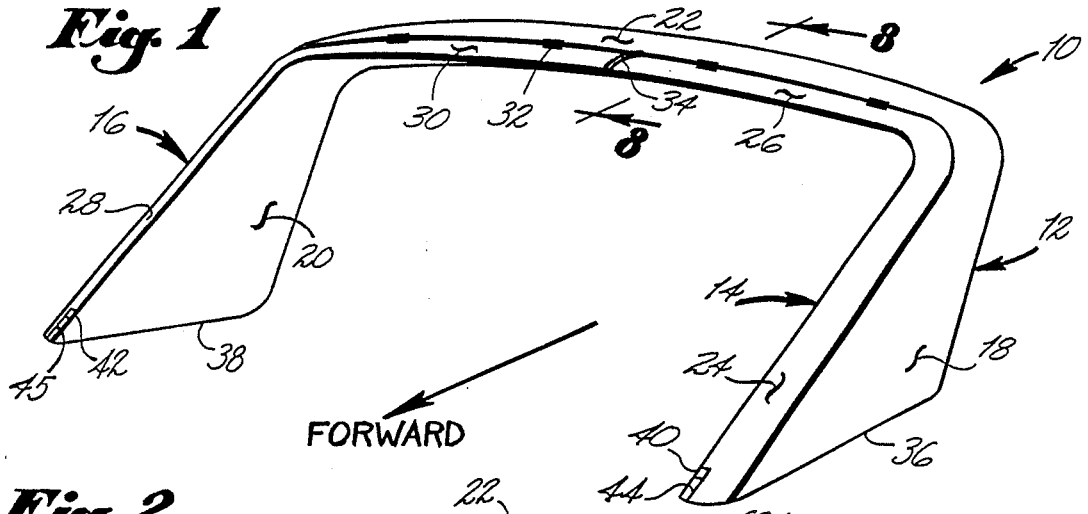
FIG. 1 is a perspective view of the preferred embodiment of the invention.

Referring now to the drawings, and particularly to FIGS. 1 to 8, the preferred embodiment of the invention is shown generally at numeral 10 and includes an arch member 12 and mating two-part covers 14 and 16. The arch member 12 includes a transverse upper portion 22 which is sized to generally span the width of the boat at its deck attachment or superstructure attachment area. The arch member 12 also includes downwardly extending side portions 18 and 20 which are structured for supportive interconnection bottom surfaces at 36 and 38, respectively, to the boat deck or superstructure.

Figure 2:
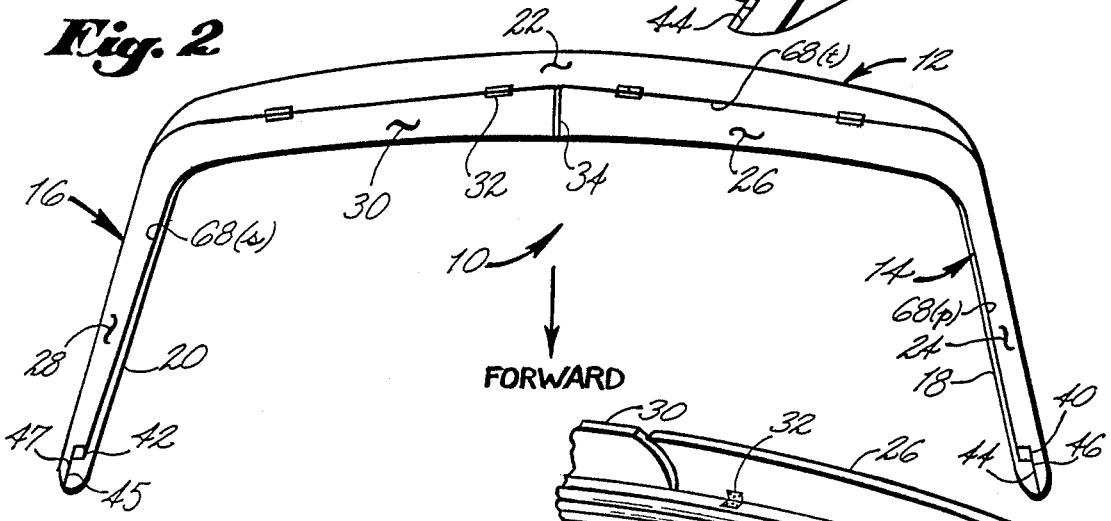
FIG. 2 is a top plan view of FIG. 1.

For reference as seen in FIGS. 1 and 2, the forward portion of the boat is indicated by the arrow. Thus, the preferred embodiment 10 is of a "raked" back design wherein both the leading and trailing edges of the radar arch 10 are generally sloped rearwardly. However, as will be again described herebelow after the invention is thoroughly understood, the invention is equally adaptive to radar arches which are either upright or slope forwardly wherein the convertible top extends rearwardly from the trailing edge of the radar arch.

Figure 3:
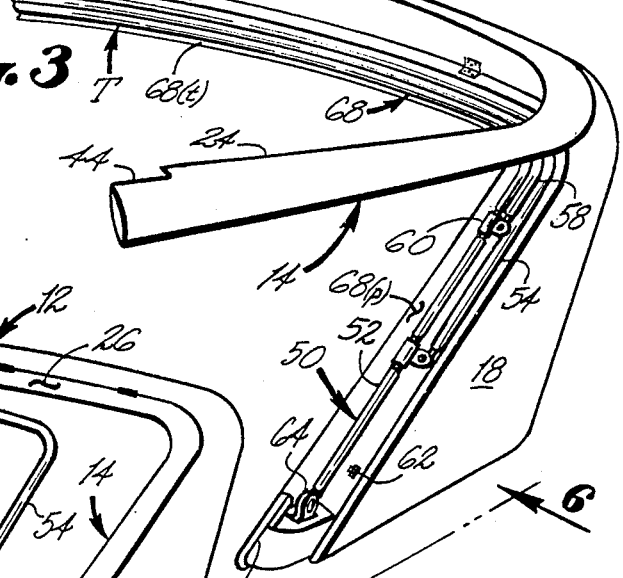
FIG. 3 is a perspective view of the port (right portion as viewed) of FIG. 1 showing the covers in their open position
Figure 4:
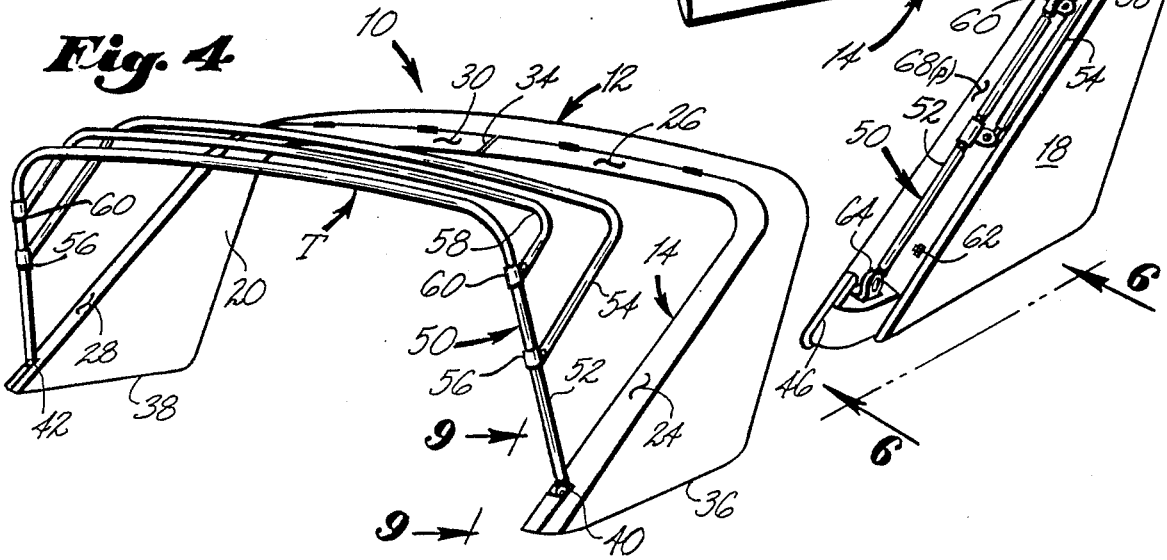
FIG. 4 is a perspective view of FIG. 1 showing the tubular bow assembly of a typical convertible top in its open configuration, the flexible fabric material being deleted for clarity.

As best seen in FIG. 4, a convertible top assembly is shown generally at T and includes a bow assembly 50 having a main bow 52 and secondary bows 54 and 58. A formed flexible sheet of thin canvas connected between and atop the bow assembly 50 is not shown for clarity. Each of these bows 52, 54, and 58 are formed of stainless steel or aluminum tubing and are oriented in a generally inverted U-configuration. Secondary bows 54 and 56 are hinge connected to the main bow 52 at clevises 56 and 60 as shown. The main bow 52 is pivotally connected and supported by clevises 64 at the lower end of the main bow 52 as best seen in FIGS. 3, 5, 6, and 7.

Figure 5:
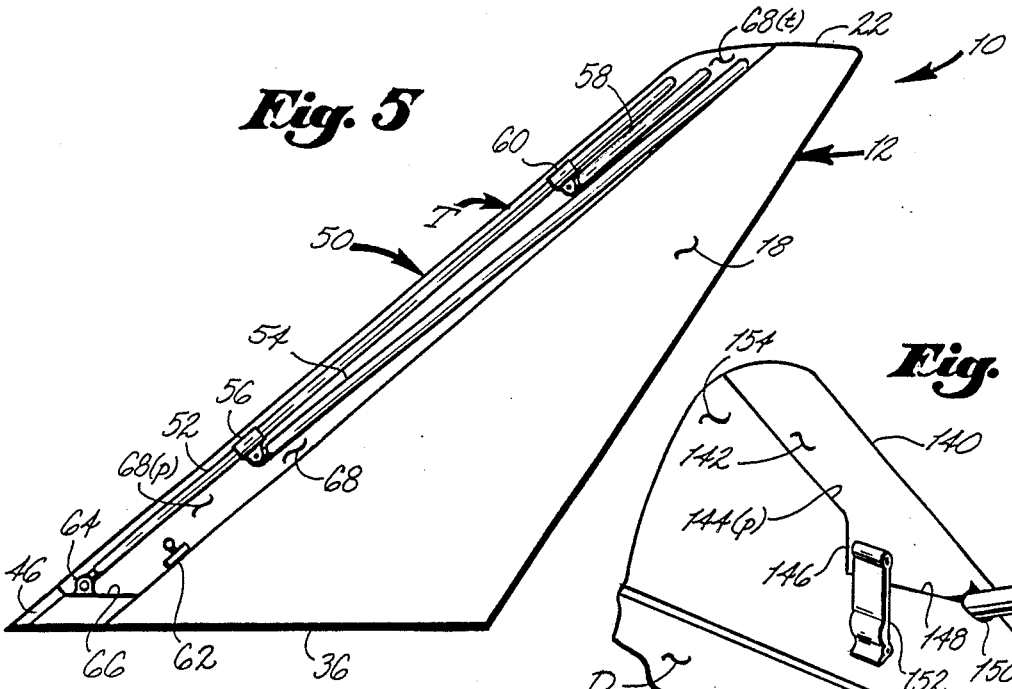
FIG. 5 is a port side (right side as viewed) elevation view of FIG. 1 absent the cover for clarity.

As best seen in FIGS. 3 and 5 to 8, although shown in concealed fashion in the other figures, the arch member 12 includes a pocket or recess shown generally at 68 formed into the leading edge of the arch assembly 12 along both side portions 18 and 20 and across the upper portion 22 at 68(*l*) 68(*r*) (not shown), and 68(*t*), respectively. This recess 68 is structured so as to receive and partially surround the complete convertible top assembly, including the bow assembly shown generally at numeral 50, the flexible formed canvas portion of the convertible top not shown for clarity. Thus in its folded position as best seen in FIGS. 3 and 5, the convertible top bow assembly 50 nests within the recess 68 such that, even without the cover arrangement which will be herebelow described, the entire convertible top T, including the flexible formed canvas sheet, which is connected between and spans atop the bow assembly 10, is partially concealed and unobtrusive.

However, to fully enclose and encase the convertible top assembly within recess 68, the two mating covers 14 and 16 is also provided. In the preferred embodiment 10, the covers 14 and 16 are formed of molded fiberglass and are connected by hinges 32 along the rearwardly edge of recess 68 and cover portions 26 and 30 as shown. These covers 14 and 16, when closed, have an outer surface configuration which completes the uninterrupted leading edge profile of the radar arch 12. This is desirable because radar arches generally are intended to have a stylish overall appearance which enhances marketability of boats while also serving as a functional addition thereto.

Figure 8:
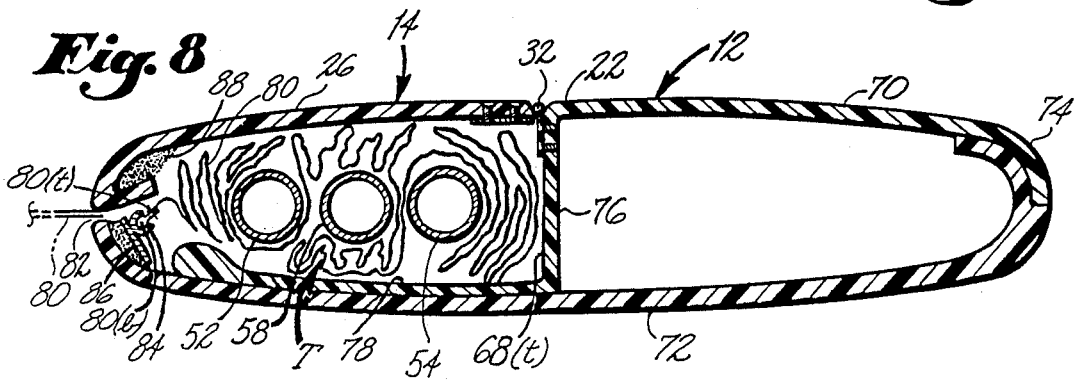
FIG. 8 is a section view in the direction of arrows 8—8 in FIG. 1.

Thus in their closed configuration as shown in FIGS. 1, 2 and 8, the covers 14 and 16 give a finished, uninterrupted, and smooth overall appearance to the leading edge of the radar arch 10 while also fully completing the concealment of the convertible top assembly T in its folded orientation within recess 68.

Figure 6:
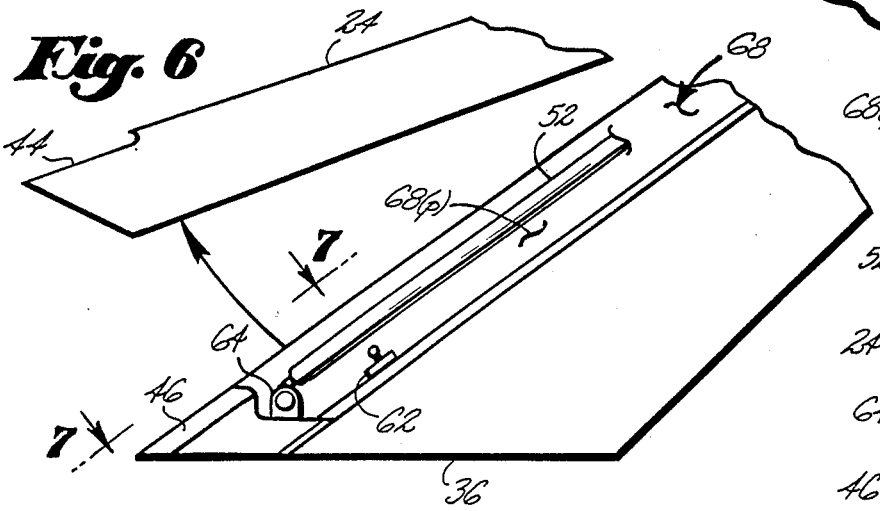
FIG. 6 is an enlarged view in the direction of arrows 6—6 in FIG. 3 showing the cover in a partially opened position.
Figure 7:
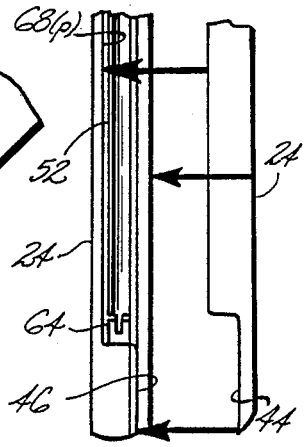
FIG. 7 is an enlarged exploded view in the direction of arrows 7—7 in FIG. 6.

To deploy the convertible top assembly T, the covers 14 and 16 are pivoted upwardly about hinges 32 as best seen :n FIGS. 3 and 6. Thereafter, the bow assembly 50 is pivoted forward about clevises 64 into the orientation shown in FIG. 4. The formed flexible canvas material (not shown except in FIG. 8) attached to the bow assembly 50 automatically is withdrawn as the bow assembly 50 is opened. Typically, flexible straps (not shown) connected to the main bow 52 are then tensioned and are connected to brackets attached to the deck or superstructure of the boat so as to maintain the bow assembly 50 in its open configuration. Thereafter, covers 14 and 16 are then closed. Cabinet brackets 62 interengage onto mating portions connected on the inner surface of cover portions 24 and 28 so as to maintain the covers 14 and 16 in their closed position. Cover portions 24 and 28 also include notches 44 and 45 which are cooperatively structured with surfaces 46 and 47 as best shown in FIGS. 2 and 3 so as to provide a notch or opening 40 and 42 to accommodate and provide clearance for the main bow 52 extending outwardly therethrough from clevises 64 in the open configuration of the convertible top assembly T.

Referring particularly to FIG. 8, the convertible top assembly T is shown in its folded configuration within recess 68 and with the cover assembly 14 in its closed position. The main bow 52 and secondary bows 54 and 58 nest conveniently within recess 68 and the flexible canvas shown generally at numeral 80 is randomly folded therebetween and within recess 68. The trailing transverse edge 80(*t*) of canvas 80 includes an elongated bead 80(*b*) formed or sewn thereinto. This bead 80(*b*) is slidably engageable and secured within metal channel 84 which is rigidly mounted within recess 68 along its leading edge by plate 86 as shown. Thus, when canvas 80 is extended forwardly through slit 82 formed between the leading edge of upper portions 26 and 28 of cover assembly 14 as shown in phantom, the entire trailing edge of canvas 80 is thusly supported. As previously described, the flexible straps (not shown) when tensioned against main bow 52 thus stretch the canvas 80 taught in the open position during use.

It is here noted that canvas 80 may be in the form of either a convertible top which snap connects to the upper margin of the boat's windshield so as to enclose a portion of the cockpit or flying bridge area of a boat or may extend to its own unsupported leading edge formed by main bow 52 in the form of a well-known "bimini" top over either the cockpit and windshield area or the flybridge area of the boat.

Figure 9:
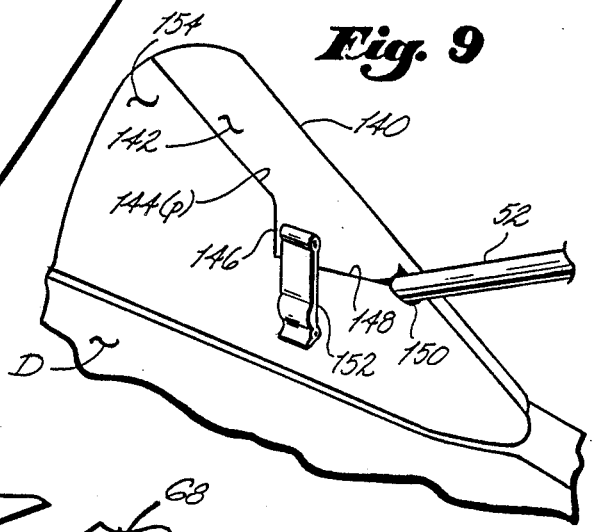
FIG. 9 is a perspective view of the inner forward surface of the base portion of the preferred embodiment of the invention.

Referring now to FIG. 9, an alternate embodiment of the cover 140 on the port side of the boat (the starboard side not shown) is there shown atop boat deck D. Main bow 52, as part of the previously described convertible top assembly T, is shown in its opened position extending through notch 150. The cover 140 includes a downward portion 142 which mates over and encloses recess 144(*p*) on the port side and also includes extension 146 which extends somewhat downward into the inner surface of the port side panel 154 which includes notch 148 to matably receive this extension 146. In addition to affording a more advantageous molded parting line between cover 140 and recess 144(*p*), extension 146 also facilitates use of a conventional overcenter type locking bracket 152 which is connected at its upper end to extension 146 and at its lower end to side panel 154 as shown. This lock 152, in addition to the cabinet lock 62 previously described, further secures the cover 140 in its closed position.

Referring now to FIGS. 10 and 11, the starboard cover (port cover not shown) in modified form is shown generally at numeral 16'having an overall molded fiberglass structure as previously described. However, in this embodiment 16', a bundle of uni-directional fiberglass shown generally at 88 is added and rigidly connected along the inner surface of the leading edge of the cover 16'. Additionally, cover portion 30 includes a twist or warp as shown in FIG. 11 wherein the central longitudinal edge 30(*a*) is lower than the opposite end 30(*b*) of cover portion 30. Both of these features are intended to address the problem of vibration of the covers 16' and 18' (not shown) against the arch member 12 while the boat is under way, both with respect to wave action and wind action which each impose an adverse vibrational environment on such structure.

These features shown in FIGS. 10 and 11 are both intended to provide a substantial downward biasing pressure at 98 against the mating surface of either the leading edge of the recess 68(*t*) and/or the flexible canvas 80 which outwardly extends therebetween when the convertible top T is opened for use. The unidirectional fiberglass bundle 88, formed of thin strands of unidirectional fiberglass, acts as a "torsion bar". This bundle 88 extends from 92 to at least 94 along the leading edge of cover 16' and may also extend as far as 96 if desired.

Thus, when central portion 98 is forced upwardly in the direction of the arrow in FIG. 11 when the cover 16' is closed, both the twist formed into 30 and the fiberglass strand bundle 88 torsionally flex to increase the pressure along 98 to prevent rattling of the panel 30.

Referring lastly to FIGS. 12 and 13, another embodiment of the invention is shown generally at 100. This embodiment 100 also includes a "raked" back arch member 102 having transverse upper portion 110 which spans the width of the boat deck or superstructure and downwardly extending port and starboard side panels 106 and 108, respectively, which are structured for interconnection at bottom surfaces 134 and 136, respectively, to the boat. As previously described, a groove recess shown generally at 138 extends along the entire leading edge of the arch member 102 to supportively receive and partially conceal the convertible top assembly T as previously described. However, in this embodiment 100, the cover assembly shown generally at numeral 104 includes four covers 112 and 114 along the port and starboard sides, respectively, and 116 and 118 along the upper recess portion 138(*t*) and divided centrally along 122. Covers 116 and 118 are hinge connected at 128 to the rearward edge of recess portion 138(*t*) while covers 112 and 114 are hingedly connected by elongated piano hinges 128 along the rearward edge of recesses 138(*p*) and 138(*s*) as shown. Covers 112 and 114 include notches 130 and 132, respectively, to allow the main bow 152, connected by clevises 64 within the lower end of recess portions 138(*p*) and 138(*s*) as previously described to extend outwardly therethrough in the open position of the convertible top assembly. Although this embodiment 100 requires four separate covers 112, 114, 116, and 118 which must be fabricated from molded fiberglass and are thus somewhat more expensive, this embodiment 100 may be preferred due to enhanced functionality in opening and closing the cover assembly 104.

It is here noted that, although all of the embodiments previously described are with respect to a rearwardly "raked" radar arch wherein the convertible top assembly extends forwardly from the leading edge of the radar arch, nonetheless the invention is equally adaptable to radar arches which are either generally upright or forwardly raked, the invention being disposed in the trailing edge of the radar arch for convertible tops which extend rearwardly from the trailing edge of the radar arch. Simply envisioning the above-described features in mirror-type image form as viewed from the side of the boat will quickly facilitate understanding this alternate embodiment (not shown) and is intended to be fully within the scope of this disclosure and invention. Likewise, the invention is equally adaptable to radar arches which have leading and trailing edges which are generally upright and not raked in either direction. However, boat manufactures prefer raking the radar arches either forwardly or rearwardly for style and, with respect to the present invention, such a raked feature increases the overall effective length of the convertible top for enhanced functionality.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

I claim:

1. A radar arch structured for connection onto a deck or superstructure of a boat comprising:

a rigid arch member having a generally inverted U-shaped configuration, a leading edge and a trailing edge, and including a transverse upper portion generally spanning the width of the deck or superstructure and a pair of downwardly extending side portions each structured at its lower end for connection to the deck or superstructure;

each of said sides and said upper portion including a continuous recess extending into one of said edge;

said recess structured to supportively receive and partially enclose a collapsible convertible canvas top having a bow assembly supportively connected to a formed sheet of flexible fabric when the top is in its folded position;

a cover having an open and a closed position connectable to said arch member and cooperating with said recess to substantially completely enclose the folded top in its folded position when cover is in its closed position;

said cover structured in its open position to allow the top to be pivoted into its open position for use;

said cover having an outer surface configuration continuous and uninterrupted with the outer surface of said arch member when said cover is in its closed position.

2. A radar arch as set forth in claim 1, further comprising:

a closure for lockably securing said cover into said closed position.

3. A radar arch as set forth in claim 1, wherein:

said radar arch is raked rearwardly whereby the length of the top may be increased.

4. A radar arch as set forth in claim 1, wherein:

the flexible sheet of the top has a transverse trailing edge which is connected within and adjacent a distal edge of said recess spanning said arch member upper portion.

5. A radar arch as set forth in claim 1, wherein:

said cover is divided into four elongated cover portions divided centrally generally along the longitudinal plane of the boat and generally at the upper corners of said arch member;

each said cover portion hinge connected to said arch member along said recess.

6. A radar arch as set forth in claim 1, wherein:
said cover is hinge connected along said recess.

7. A radar arch as set forth in claim 6, wherein:
said cover is divided centrally into two generally L-shaped cover portions generally along the longitudinal axis of the boat.

8. A radar arch as set forth in claim 7, wherein:
each said cover portion includes a twist extending from said central division toward the outer upper corner of said arch member;
each said twist downwardly biasing the forward and innermost central corner of each said cover portion against said recess when said cover is in its closed position.

9. A radar arch as set forth in claim 8, further comprising:
a bundle of unidirectional fibers molded into the leading edge of each said cover portion and extending along said area of twist whereby said fiber bundle also twists for added downwardly biasing of the forward and innermost central corner of each said cover portion against said recess when said cover is in its closed position.

10. A radar arch as set forth in claim 1, wherein:
said cover is notched to allow a main bow of the top to extend therethrough and forming an elongated slit between a distal transverse edge of said cover and the mating portion of said arch member to allow the flexible sheet to extend outwardly therebetween when the top is in its open position and said cover is in its closed position.

* * * * *